United States Patent [19]

Becka

[11] 4,134,278

[45] Jan. 16, 1979

[54] MACHINE FOR PERFORMING AN OPERATION ALONG A NON-RECTILINEAR WORKPIECE PERIPHERY

[75] Inventor: Michael M. Becka, Nashua, N.H.

[73] Assignee: International Shoe Machine Corporation, Nashua, N.H.

[21] Appl. No.: 854,947

[22] Filed: Nov. 25, 1977

[51] Int. Cl.[2] ..... C14B 1/44; A43D 95/00

[52] U.S. Cl. ..... 69/6.5; 12/1 R; 12/77

[58] Field of Search ..... 69/6.5; 12/4.1, 1 R, 12/1 B, 1 F, 70, 77, 17 R, 17.2; 51/98; 91/441

[56] References Cited

U.S. PATENT DOCUMENTS

| | | | |
|---|---|---|---|
| 3,157,896 | 11/1964 | Kamborian et al. | 12/4.1 |
| 3,975,932 | 8/1976 | Vornberger | 69/6.5 |
| 4,020,660 | 5/1977 | Bergeron | 69/6.5 |

*Primary Examiner*—Patrick D. Lawson
*Attorney, Agent, or Firm*—Albert Gordon

[57] ABSTRACT

A machine for roughing the margin of a shoe upper a desired distance inwardly of the non-rectilinear margin periphery during the rectilinear movement of a shoe assembly, comprising the upper mounted on a last, past a roughing tool. A sensing member, movable towards and away from the shoe assembly in unison with the roughing tool, is caused to bear against the side of the shoe assembly during the shoe assembly movement and the roughing tool is so spaced from the sensing member as to be engageable with the margin. The sensing member is laterally offsettable during the shoe assembly movement to insure that the roughing tool engages the upper margin inwardly of the margin periphery during the movement of upper margin peripheral portions that are inclined with respect to the direct of rectilinear movement of the shoe assembly.

6 Claims, 8 Drawing Figures

MACHINE FOR PERFORMING AN OPERATION ALONG A NON-RECTILINEAR WORKPIECE PERIPHERY

BACKGROUND OF THE INVENTION

This invention is an improvement of a machine, of the type shown in U.S. Pat. Nos. 3,975,932 and 4,020,660, which operates on a shoe assembly comprised of an upper mounted on a last and an insole located on the last bottom with the margin of the upper secured to the last bottom, by roughing the upper margin a desired distance inwardly of the margin periphery including a non-rectilinear portion of the margin periphery. The prior machine includes a support for supporting the shoe assembly; a sensing member, located rearwardly of the support, adapted to engage a non-rectilinear side of the shoe assembly corresponding to the non-rectilinear portion of the margin periphery; a roughing tool, having an operating portion located forwardly of the sensing member in forward-rearward alignment with the sensing member, adapted to perform the roughing operation; means for so moving the support as to move the shoe assembly side past the sensing member and as to move the corresponding portion of the upper margin past the roughing tool; and means for causing the sensing member and the roughing tool to so move forwardly and rearwardly in unison during the support movement as to enable the sensing member to be in engagement with the workpiece side and as to enable the roughing tool to perform the roughing operation along the upper margin.

As explained in U.S. Pat. No. 3,975,932, when roughing curved concave portions of the sides of the shoe assembly with the prior machine of this patent, the roughing tool tends to rough the upper margin too close to the margin periphery where the upper side joins the upper margin which is undesirable as the roughed upper would then be visible in a finished shoe. In order to overcome this deficiency, in the machine of U.S. Pat. No. 3,975,932 the roughing tool is so mounted as to be displaceable along its line of forward-rearward alignment with the sensing member so that it can be moved a relatively great distance forwardly of the sensing member when the curved concave side portions of the upper margin are moved past the roughing tool. However, the amount that the roughing tool should be displaced along the line of forward-rearward alignment in the arrangement of U.S. Pat. No. 3,975,932 is proportional to the angle that the tangent of the curved portion of the margin makes with the rectilinear path of movement of the shoe assembly in its movement past the sensing member and the roughing tool, and this angle varies with different segments of the curved side of a particular shoe assembly, is different for the inside and outside side portions of a particular shoe assembly, and is different for different styles and sizes of shoe assemblies.

SUMMARY OF THE INVENTION

The object of this invention is to provide an arrangement, for incorporation in a machine of the type shown in U.S. Pat. Nos. 3,975,932 and 4,020,660, which will automatically displace the roughing tool forwardly of the margin periphery during the movement of the curved portions of the sides of the shoe assembly an amount that is proportional to the angle that the tangent of any particular segment of a curved portion makes with the line of movement of the shoe assembly past the sensing member and the roughing tool. This is accomplished by mounting the sensing member for lateral movement between a central position, in which the roughing tool is in forward-rearward alignment with the sensing member, and laterally offset positions on opposite sides of the central position, and by providing powered means, effective during the support movement, to effect lateral movement of the sensing member from one of these positions to a selected other of these positions.

While the invention is disclosed as having its preferred utility in a roughing machine as discussed above, it can be practiced in other environments than roughing the upper margin of an upper forming a component of a shoe assembly comprising the upper mounted on a last and an insole located on the last bottom. For example, the invention has utility in coating a loose sole with a ribbon of cement a desired distance inwardly of the curved periphery of the sole as in U.S. Pat. No. 2,294,472. Therefore, in the broadest aspects of this invention, the workpiece need not be a shoe assembly and the tool need not be a roughing tool.

DESCRIPTION OF THE PREFERRED EMBODIMENT

Figure 1:
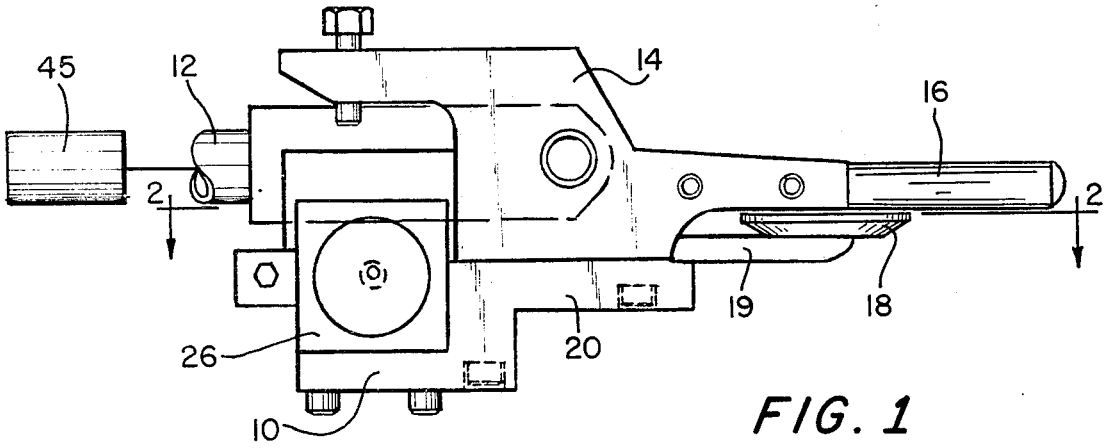
FIG. 1 is a side elevation of the mechanism for laterally offsetting the sensing member.

The operator is intended to be located to the right of the mechanism shown in FIG. 1. Directions extending towards the operator (left to right in FIG. 1) will be designated as "forward" and directions extending away from the operator (right to left in FIG. 1) will be designated as "rearward". The front of the machine or of a machine part is closest to the operator and the back of the machine or of a machine part is furthermost from the operator.

Figure 2:
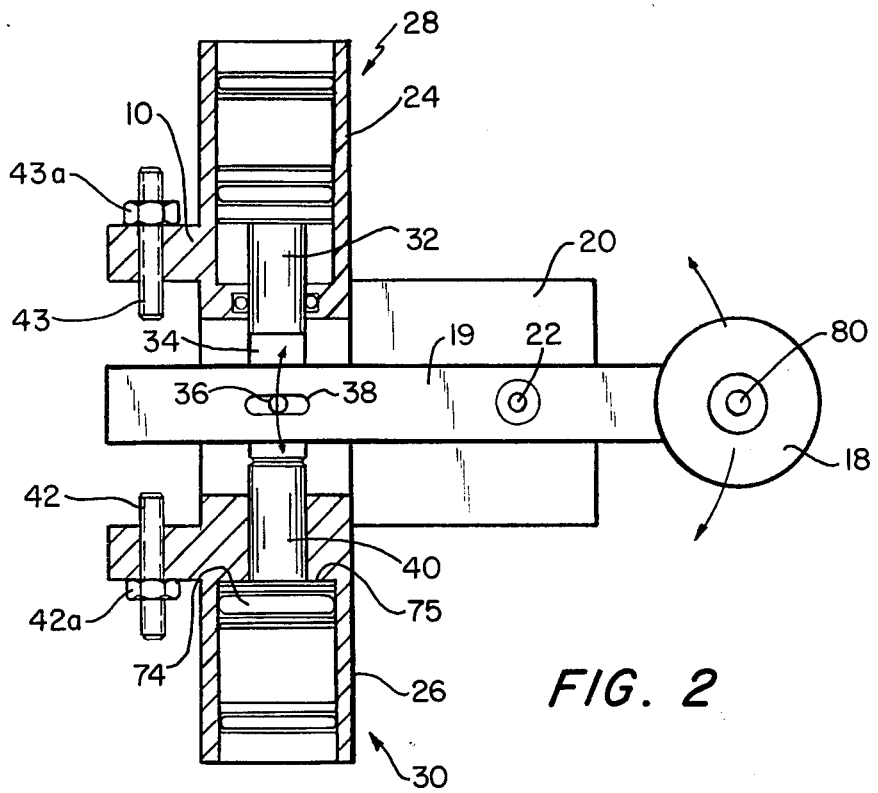
FIG. 2 is a plan view taken along the line 2—2 of FIG. 1.

A margin sensing mechanism, as shown in FIGS. 1 and 2, comprises a mount 10 that is anchored to the front of a shaft 12. A fork 14, having a pair of forwardly extending tines 16 (see also FIG. 4A), is mounted to the mount 10. A circular sensing member 18 is rotatably mounted to the front of a bar 19 and the bar 19 is pivoted to a ledge 20 of the mount 10 by a pivot pin 22 to thereby mount the sensing member 18 for swinging movement transversely of the fork 14 and the tines 16. The back of the bar 19 extends between motor housings 24 and 26 that are mounted to opposite sides of the mount 10. The housings 24 and 26 respectively form cylinders of air operated motors 28 and 30. The piston rod 32 of the motor 28 has a cut out 34 that accommodates the back of the bar 19. A pin 36 in the cut out 34 is received in an elongated slot 38 in the bar 19 whereby movement of the piston rod 32 in the cylinder 24 causes transverse or lateral swinging movement of the sensing member 18 about the axis of the pin 22. The piston rod 40 of the motor 30 is movable towards and away from the piston rod 32 and the inner ends of the piston rods 32 and 40 may abut each other. Threaded stop rods 42 and 43 are so adjustably mounted respectively in the housings 26 and 24 by bolts 42*a* and 43*a* as to be in intersecting relationship with the opposite sides of the back of the bar 19 to thereby adjustably limit the extent of swinging movement of the bar 19, together with the sensing member 18, about the axis of the pin 22.

Figure 4:
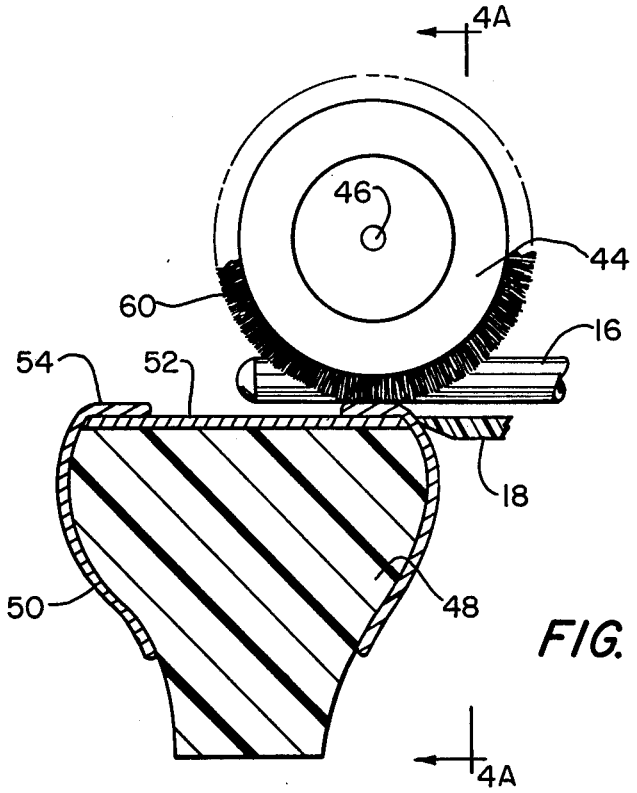
FIG. 4 is a section showing the shoe assembly being engaged by the sensing member and the roughing tool.
Figure 4A:
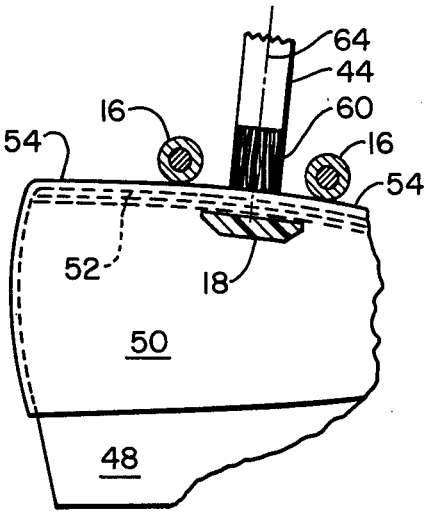
FIG. 4A is a view taken along the line 4A—4A of FIG. 4.

Referring to FIGS. 4 and 4A, a rotatable roughing tool 44 is so located, in the manner shown in U.S. Pat. No. 4,020,660, that its lowermost position, hereafter referred to as its operating position, is located between the tines 16 and forwardly of the sensing member 18.

The machine construction and mode of operation set forth below is shown in U.S. Pat. No. 4,020,660 except where distinguished from U.S. Pat. No. 4,020,660.

The shaft 12, the tines 16, and the sensing member 18 are mounted for unitary forward-rearward movement, unitary heightwise movement, and unitary swinging movement about the axis of the shaft 12. The tool 44 is mounted for inward-outward movement and heightwise movement in unison with the shaft 12, the tines 16, and the sensing member 18 and is also mounted for heightwise movement with respect to the shaft 12, the tines 16, and the sensing member 18.

Unlike the construction in U.S. Pat. No. 4,020,660, the shaft 12 is so connected to an air operated motor 45 (FIG. 1) as to either cause the shaft 12, together with the tines 16, the sensing member 18 and the tool 44, to be located in an idle rearward position or to be yieldably urged forwardly under the force of pressurized air. Alternatively, the location of the shaft 12, together with the tines 16, the sensing member 18 and the tool 44, in its idle position and the yieldable forward urging of the shaft 12, together with the tines 16, the sensing member 18 and the tool 44, may be controlled by a servo follow-up mechanism similar to that disclosed in U.S. Pat. No. 4,020,660.

In the idle condition of the machine: the shaft 12, the tines 16, the sensing member 18 and the tool 44 are maintained in a rearward and upper position by the motor 45 or by the servo follow-up mechanism of U.S. Pat. No. 4,020,660; the shaft 12 is so swung about its axis that the tines 16 and the sensing member 18 lie in substantially horizontal planes and the axis of rotation 46 of the roughing tool 44 is substantially horizontal; a motor (not shown) is rotating the tool 44; and the tool 44 is in a relatively elevated position with respect to the shaft 12, the tines 16 and the sensing member 18.

Figure 3:
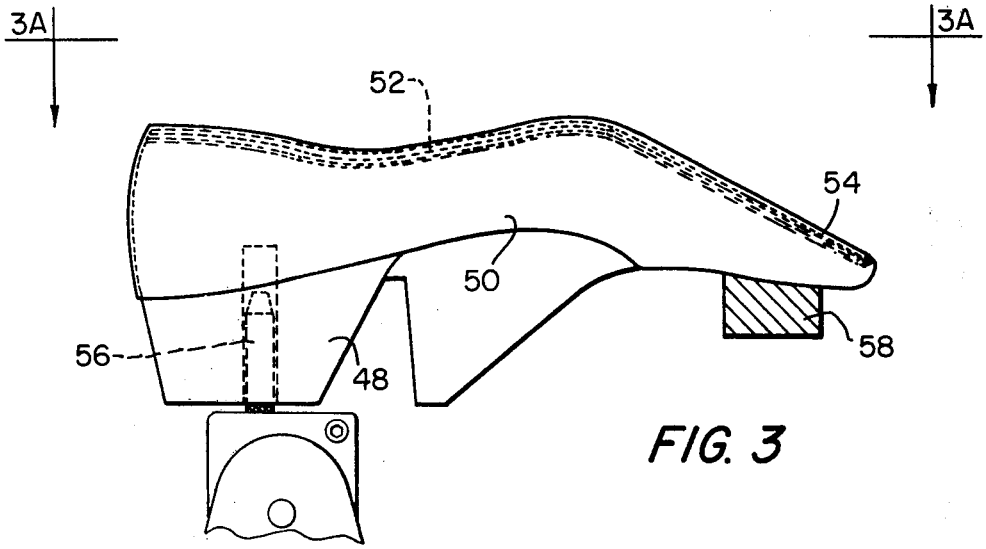
FIG. 3 is a side elevation of a shoe assembly mounted in the machine.
Figure 3A:
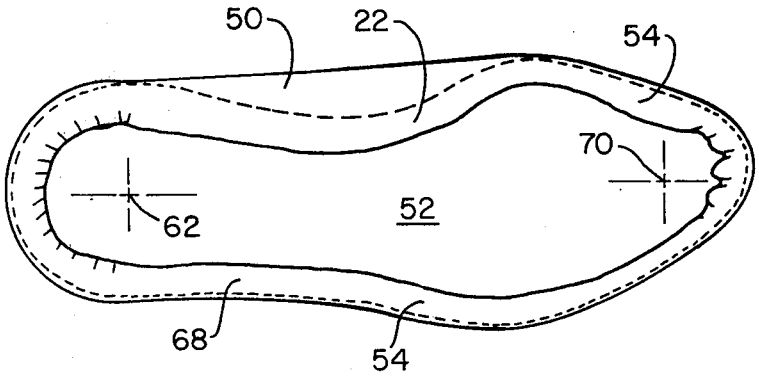
FIG. 3A is a plan view taken along the line 3A—3A of FIG. 3.

FIGS. 3 and 3A show a shoe assembly that comprises a last 48 having an upper 50 mounted thereon and an insole 52 located on its bottom. The upper 50 has been lasted so that the upper margin 54 lies against and is secured to the insole 52 and extends inwardly of the periphery of the insole and of the last bottom.

The shoe assembly is mounted by the operator bottom-up on a shoe assembly support comprised of a last pin 56 and a toe pad 58, with the last pin 56 entering the conventional thimble hole in the top of the heel portion of the last 48, and is locked to the shoe assembly support.

After the shoe assembly has been locked to the shoe assembly support, the shaft 12, together with the tines 16, the sensing member 18, and the tool 44, is lowered until the tines 16 engage the upper margin 54 in one of its breast line regions (FIGS. 4 and 4A), the shoe assembly being so located that the tines 16 will intersect its bottom during their descent and the sensing member 18 will be located rearwardly of the shoe assembly when the tines 16 engage the shoe assembly. In response to the engagement of the tines 16 with the upper margin 54, the shaft 12, together with the tines 16, the sensing member 18 and the tool 44, is yieldably urged forwardly by the motor 45 or by the servo follow-up mechanism of U.S. Pat. No. 4,020,660. After a time delay sufficient to enable the sensing member 18 to engage the side of the shoe assembly, the tool 44 is moved downwardly with respect to the shaft 12, the tines 16 and the sensing member 18 until radially projecting bristles 60 on the tool 44 engage the upper margin 54 between the tines 16, as indicated in FIGS. 4 and 4A. After the time delay referred to in the preceding sentence, the shoe assembly support 56, 58, together with the shoe assembly, is caused to rotate about a center that is substantially in alignment with the last pin 56 and that lies approximately at the center of curvature, indicated by number 62 in FIG. 3A, of the heel portion of the bottom of the shoe assembly.

From the foregoing, it can be seen that the engagement of the tines 16 with the upper margin 54 causes a lowering of the rotating tool 46 into engagement with the upper margin 54 and a movement of the heel portion of the upper margin past the rotating tool. This arrangement enables the tool bristles 60 to abrade or rough the upper margin 54 as it is moving past the tool 46.

During the movement of the heel portion of the upper margin 54 past the rotating tool 46, as well as the movement of the other portions of the upper margin 54 past the rotating tool 46, the tool 46 must move upwardly or downwardly in accordance with the elevation of the upper margin being roughed and must move forwardly or rearwardly so as to be positioned the desired distance forwardly of the outer periphery of the upper margin being roughed. In addition, the central plane of the tool 44, which is at right angles to its axis of rotation and which is indicated by the chain line 64 in FIG. 4A, should be tilted during the movememt of the portions of the upper margin being roughed past the tool 44 so as to be at right angles to the plane of the portion of the upper margin 54 being roughed.

The upward and downward movements of the tool 44 during the movement of the upper margin 54 past the tool is accomplished in the manner shown in U.S. Pat. No. 4,020,660. The forward and rearward movements of the tool 44 during the movement of the upper margin 54 past the tool is accomplished by the sensing member 18 which is being resiliently urged forwardly against the side of the shoe assembly by the motor 45 or by the servo follow-up mechanism of U.S. Pat. No. 4,020,660. The tilting of the central plane 64 of the tool 44 is accomplishd in the manner shown in U.S. Pat. No. 4,020,660.

After the shoe assembly has rotated 180° abot the axis 62 to enable the heel portion of the upper margin from one breast line portion to the other breast line portion to be roughed by the tool 44, this rotation of the shoe assembly terminates. This is followed by a movement of the shoe assembly linearly in a heel to toe direction past the tool 44 to thereby enable the tool 44 to rough a first side portion 68 of the upper margin 54. This linear movement is terminated when the tool 44 is in substantial widthwise alignment with the approximate center of curvature 70 (FIG. 3A) of the toe portion of the shoe assembly.

After the shoe assembly has completed its heel to toe linear movement, it is caused to rotate 180° about the axis 70, in the same direction in which it had previously rotated about the axis 62, to thereby enable the toe portion of the upper margin 54 to be swung past the tool 44 and be roughed. This is followed by a linear movememt of the shoe assembly in a toe to heel direction past the tool 44 to cause the tool 44 to rough the second side portion 72 of the upper margin 54, the linear movement being terminated when the tool 44 reaches the area of its initial engagement with the upper margin 54.

When the shoe assembly has completed its toe to heel linear movement, the machine parts are returned to their idle positions and the machine cycle is completed. The shoe assembly, with the roughed upper margin, is now removed from the machine.

The motor 28 is a double acting motor so connected to a source of pressurized air as to selectively enable the piston rod 32 to be power driven inwardly or outwardly. The motor 30 is a single acting motor so connected to a source of pressurized air as to selectively enable the piston rod 40 to be power driven inwardly by the pressurized air or to have the pressurized air vented so that there is no force of pressurized air acting on the piston 74 of the motor 30. The force of pressurized air applied to the motor 30 to move the piston rod 40 inwardly is of greater magnitude than the force of pressurized air applied to the motor 28 to move the piston rod 32 inwardly.

In the idle position of the machine and during the machine cycle, except for portions of the machine cycle described below, pressurized air is so entering the motors 28 and 30 as to respectively force their piston rods 32 and 40 inwardly. Due to the greater force applied to the motor 30, the piston 40 is forced inwardly to its greatest extent, as indicated in FIG. 2, with the piston 74 abutting the wall 75 of the cylinder 26, and the piston rod 32 is forced inwardly to a position wherein it abuts the piston rod 40, as also indicated in FIG. 2. In this central position the bar 19 extends in a forward-rearward direction and the center 80 of the sensing member 18 is in forward-rearward alignment with the tool 44.

Figure 5:
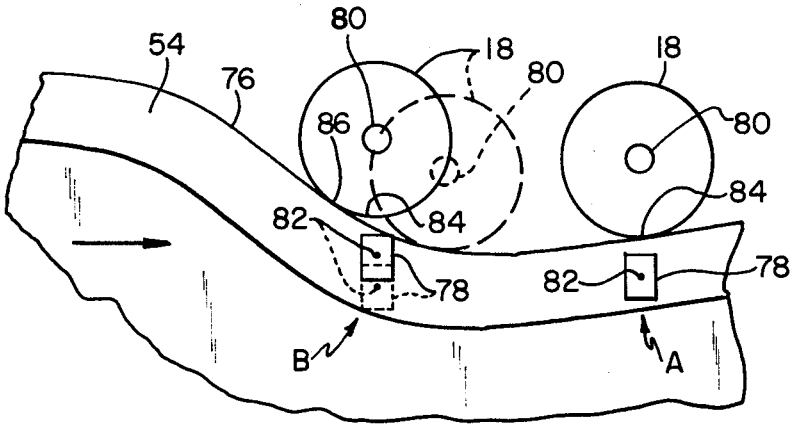
FIG. 5 is a representation of the inside side portion of the bottom of a right foot shoe assembly moving past the sensing member.
Figure 6:
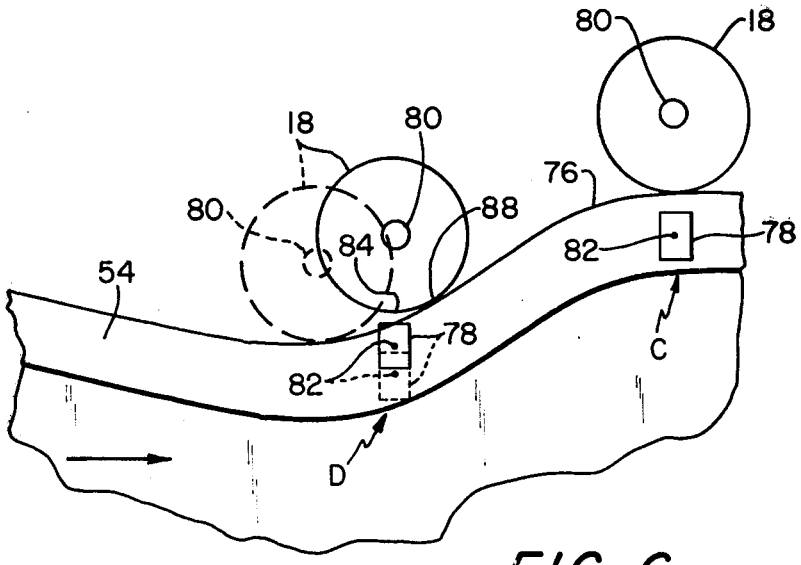
FIG. 6 is a representation of the inside side portion of the bottom of a left foot shoe assembly moving past the sensing member.

FIGS. 5 and 6 are schematic representations of movements of certain portions of the upper margin periphery 76 past the tool station that is comprised of the sensing member 18 and the tool 44. In these figures, the areas of engagement of the bottom of the tool 44 with the upper margin 54 are indicated by the number 78. In the movement of all portions of the periphery of the upper margin 54 past the tool station, the forward-rearward distance between the center 80 of the sensing member 18 and the center 82 of the area of engagement 78 is a constant. Regardless of which side of the shoe assembly is being moved past the tool station, the sides of the upper margin 54 being roughed is always being moved past the tool station in the same direction, this direction being indicated by the arrow pointing in a left to right direction in each of FIGS. 5 and 6.

In FIG. 5, the inside shank portion of the upper margin periphery of a right foot shoe assembly is moving left to right linearly past the tool station in the direction of the arrow with the spacing between the upper margin periphery and the longitudinal center line of the shoe assembly bottom increasing as the shoe assembly moves past the tool station. At position A of the shoe assembly bottom, the periphery of the upper margin 54 is generally parallel to the linear direction of movement of the shoe assembly bottom and the forwardmost end 84 of the sensing member 18 contacting the side of the shoe assembly. Therefore, the area of engagement 78 at position A, with the center 80 of the sensing member 18 in alignment with the tool 44, is spaced a desired distance from the periphery 76 of the upper margin 54.

At position B of the shoe assembly bottom, the periphery of the upper margin 54 is so inclined with respect to the linear direction of movement of the shoe assembly bottom that the distance between the upper margin periphery 76 and the longitudinal center line of the shoe assembly bottom is gradually increasing as the upper margin periphery moves past the tool station. Therefore, in position B, a portion 86 of the sensing member 18 that is laterally offset from a line connecting points 80 and 82 on the side of this line that is opposite to the linear direction of movement of the shoe assembly is contacting the side of the shoe assembly. Also, in position B, the sensing member portion 86 is closer, in a forward-rearward direction, to the point 80 than the forwardmost end 84 of the sensing member 18. As a result, in position B, with the point 80 in forward-rearward alignment with the point 82, the area 78 would be closer to the point 80 than is the case in position A and the area 78 in position B would be, undesirably, closer to the upper margin periphery than is the case in position A, as indicated in solid lines for the area 78 in position B. In order to eliminate this undesirable effect, the sensing member 18, during the movement of the shoe assembly bottom through position B, is swung laterally in the direction of movement of the shoe assembly to the position indicated in phantom in position B, thereby moving the area 78 further away from the periphery of the upper margin as indicated in phantom in position B. This lateral offsetting of the sensing member 18 is accomplished by venting the pressurized air from the motor 30 so that the pressurized air in the motor 28 may force the piston rod 32 further inwardly and thus swing the bar 19 and the sensing member 18 about the axis of the pivot pin 22 to a position wherein the back of the bar 19 engages the stop rod 42.

In FIG. 6, the inside shank portion of the upper margin periphery 76 of a left foot shoe assembly is moving left to right linearly past the tool station in the direction of the arrow with the spacing between the upper margin periphery 76 and the longitudinal center line of the shoe assembly bottom decreasing as the shoe assembly moves past the tool station. At position C of the shoe assembly bottom, the relationship of the shoe assembly and the tool station is substantially the same as in position A of FIG. 5.

At position D of the shoe assembly in FIG. 6, the periphery 76 of the upper margin 54 is inclined oppositely to the inclination of the upper margin periphery 76 at position B of FIG. 5 so that the distance between the upper margin periphery and the longitudinal center line of the shoe assembly is gradually decreasing as the upper margin periphery moves past the tool station. Therefore, in position D, a portion 88 of the sensing member 18 that is laterally offset from a line connecting points 80 and 82 on the side of this line that is in the direction of the linear movement of the shoe assembly is contacting the side of the shoe assembly. In position D, the sensing member portion 88 is closer, in a forward-rearward direction, to the point 80 than the forwardmost end 84 of the sensing member 18. As a result, in position D, with the point 80 in forward-rearward alignment with the point 82, the area 78 would be closer to the point 80 than is the case in position C and the area 78 in position D would be, undesirably, closer to the upper margin periphery than is the case in position C as indicated in solid lines for the area 78 in position D. In order to eliminate this undesirable effect, the sensing member 18, during the movement of the shoe assembly through position D, is swung laterally opposite to the direction of movement of the shoe assembly to the position indicated in phantom in position D, thereby moving the area 78 further away from the periphery of the upper margin as indicated in phantom in position D. This lateral offsetting of the sensing member 18 as accomplished by so actuating the double acting motor 28 as to force its piston rod 32 outwardly thereby causing the pin 36 to swing the bar 19 and the sensing member 18 about the axis of the pivot pin 22 to a position wherein the back of the bar 19 engages the stop rod 43.

From the foregoing it can be seen that, during the movement of the periphery of the upper margin 54 past the tool station comprised of the sensing member 18 and the tool 44, the sensing member 18 is caused to be laterally offset from its central position of forward-rearward alignment with the tool 44 in one lateral direction or the other when, during the linear movement of the shoe assembly past the tool station, the portion of the upper margin periphery moving past the tool station is inclined with respect to the linear direction of movement of the shoe assembly. While FIGS. 5 and 7 respectively illustrate the inclined inside shank portions of the bottom of a right and left shoe assembly periphery moving past the tool station, the sensing member 18 may be similarly offset laterally when the inclined outside shank portion of the bottom of a shoe assembly is moved past the tool station.

While the sensing member 18 is laterally offset from its central position of forward-rearward alignment with the tool 44 in an arc about the axis of the pivot pin 22, this arcuate path of movement is, to all intents and purposes, equivalent to a rectilinear path that is parallel to the rectilinear path of movement of the shoe assembly past the tool station due to the relatively large radius of curvature of the arc. The extent that the tool 44 is moved forwardly and further away from the upper margin periphery 76 pursuant to the lateral offsetting of the sensing member 18 from its central position is proportional to the angle that the tangent of the curved portion of the side of the shoe assembly engaged by the sensing member makes with the rectilinear path of movement of the shoe assembly. Therefore, the degree of forward-rearward displacement of the roughing tool 44 during the movement of the inclined curved segments of the upper margin peripheries past the tool station while the sensing number is laterally offset in the appropriate direction is automatically rendered proportional to the angle that the tangent that the curved segment makes with the rectilinear path of movement of the shoe assembly past the tool station. This feature is highly desirable as the desired extent of forward movement of the tool caused by the lateral offsetting is also proportional to this angle. The settings of the stop rods 42 and 43 in the housings 23 and 24 serve to adjust the extent of the lateral offsettings of the sensing member 18 which will be dependent on the general extent of the curved portions of the sides of the shoe assembly which, in turn, is dependent on the length of the shoe assembly.

The lateral offsetting of the sensing member 18 from its central position when portions of the upper margin periphery that are generally parallel to the rectilinear direction of movement of the shoe assembly are moving past the tool station, as in position A of FIG. 5 and position C of FIG. 6, has no effect on the forward-rearward position of the tool 44 with respect to the sensing member 18. In order to ensure that the tool 44 is automatically displaced forwardly with respect to the sensing member during the movement of the inclined positions of the upper margin periphery 76 past the tool station, the sensing member is caused by the motors 28 and 30 to be laterally offset in the appropriate direction before the inclined portion engages the sensing member 18 and is caused by the motors 28 and 30 to return to its central position after the inclined portion has moved past the sensing member 18.

There follows a recapitulation of the machine parts and the mode of operation of the machine that are pertinent to this invention.

The machine is intended to perform an operation along the non-rectilinear periphery 76 of the surface 54 of the workpiece constituted by the shoe assembly. The machine includes a support, comprised of the last pin 56 and the toe pad 58, for supporting the workpiece. The sensing member 18, located rearwardly of the support, is adapted to engage a non-rectilinear side of the workpiece corresponding to its non-rectilinear periphery 76. The tool 44 has an operating portion (its lowermost portion as seen in FIG. 4) located forwardly of the sensing member 18 in forward-rearward alignment with the sensing member and the tool 44 is adapted to perform the operation on the workpiece periphery 76. Means shown in U.S. Pat. No. 4,020,660 so move the support as to move the workpiece surface 54 past the tool 44. Means shown in U.S. Pat. No. 4,020,660 or the motor 45 cause the sensing member 18 and the tool 44 to so move forwardly-rearwardly in unison during the support movement as to enable the sensing member 18 to be in engagement with the workpiece side and as to enable the tool 44 to perform the operation a desired distance inwardly of the workpiece periphery. The pin 22 serves as means mounting the sensing member 18 for lateral movement between the central position, shown in FIG. 2, in which the tool 44 is in forward-rearward alignment with the sensing member 18 and laterally offset positions on opposite sides of the central position. The motors 28 and 30 act as powered means, effective during the support movement, for effecting lateral movements of the sensing member 18 from each of said positions to a selected other of said positions.

The stop rods 42 and 43 serve as adjusting means adjusting the extent of the lateal movement imparted by the powered means 28 and 30 to the sensing member 18 laterally of its central position to thereby adjust the laterally offset positions of the sensing member.

The means mounting the sensing member 18 for lateral movement and the means for effecting the lateral movements of the sensing member 18 comprise the forward-rearwardly extending bar 19 so pivotally mounted intermediate its ends by the pin 22, which forms a pivot member, as to permit lateral swinging movement of the bar 19 about the axis of the pivot member 22. The sensing member 18 is mounted to the front of the bar 19 forwardly of the pivot member 22. The motor 28 constitutes a first motor mounted on a first side of the bar 19 and the motor 30 constitues a second motor mounted on a second side of the bar 19. The piston rods 32 and 40 respectively constitute a first drive rod and a second drive rod that respectively extend inwardly of the first motor 28 and the second motor 30 towards the rear of the bar 19 rearwardly of the pivot member 22. Means shown in FIG. 2 so relate the drive rods 32 and 40 to each other and to the rear of the bar 19 rearwardly of the pivot member 22 as to effect lateral movements of the bar 19 pursuant to inward-outward movements of the drive rods 32 and 40. The motors 28 and 30 are so actuated as to effect the lateral movements of bar 19 and thus effect the lateral movements of the sensing member 18.

The adjusting means, formed by the stop rods 42 and 43 constitute stop members adjustably mounted on each side of the bar 19 for inward-outward adjustment, the stop members 42 and 43 being intersecting relationship with the bar 19 to adjust the extent of lateral movements of the bar 19 to thereby adjust the laterally offset positions of the sensing member 18.

The stop member 43 is a first stop member that is mounted on the first side of the bar 19 in intersecting relationship with the first side of the bar. The stop member 42 is a second stop member that is mounted on the second side of the bar 19 in intersecting relationship with the second side of the bar. The inner ends of the first drive rod 32 and the second drive rod 40 are in intersecting relationship. The means shown in FIG. 2 that so relate the drive rods 32 and 40 to each other and to the rear of the bar 19 as to effect lateral movements of the bar pursuant to inward-outward movements of the drive rods includes a connection, formed by the pin 36 and the slot 38, between the first drive rod 32 and the rear of the bar 19 so constituted as to effect the lateral movements of the bar 19 pursuant to inward-outward movements of the first drive rod 32. The wall 75 of the cylinder 26 constitutes second limit means incorporated in the second motor 30 for limiting the extent of inward movement of the second drive rod 40. The control for the first motor 28 includes actuable means to selectively impart inwardly or outwardly directed forces to the first drive rod 32. The control for the second motor 30 includes actuable means to selectively impart an inwardly directed force to the second drive rod 40 of greater magnitude than the inwardly directed force imparted to the first drive rod 32 by the first motor 28 or to relieve the inwardly directed force imparted to the second drive rod 40. The motors 28 and 30 are so actuated as to effect the lateral movements of the bar 19 by: (a) so actuating the first motor and the second motor 30 as to impart inwardly directed forces to the first drive rod 32 and the second drive rod 40 so that the drive rods 32 and 40 abut each other with the limit means 75 determining the positions of the drive rods and the connection 36, 38 placing the sensing member 18 in the central position; (b) so actuating the second motor 30 that the force imparted by the second motor 30 is relieved thereby enabling the inwardly directed force applied to the first drive rod 32 by the first motor 28 to move the first drive rod 32 further inwardly and thereby move the bar 19 laterally until the bar 19 engages the second stop member 42 and the connection 36, 38 causes the sensing member 18 to move into a first of the laterally offset positions; and (c) so actuating the first motor 28 as to impart the outwardly directed force to the first drive rod 32 to move the first drive rod 32 outwardly and thereby move the bar 19 laterally until the bar 19 engages the first stop member 43 and the connection 36, 38 causes the sensing member 18 to move into the second of the laterally offset positions.

The bolts **42*a* and 42*b* act as means adjustably mounting the stop member 42 and 43 for inward-outward adjustment to adjust the laterally offset positions of the sensing member 18**.

I claim:

1. A machine for performing an operation along a non-rectilinear periphery of a workpiece surface comprising: a support for supporting the workpiece; a sensing member, located rearwardly of the support, adapted to engage a non-rectilinear side of the workpiece corresponding to said non-rectilinear periphery; a tool, having an operating portion located forwardly of the sensing member in forward-rearward alignment with the sensing member, adapted to perform said operation; means for so moving the support as to move said workpiece side past the sensing member and as to move the corresponding portion of said workpiece past the tool; and means for causing the sensing member and the tool to so move forwardly-rearwardly in unison during said support movement as to enable the sensing member to be in engagement with said workpiece side and as to enable the tool to perform said operation along said workpiece periphery; the machine characterized in having the improvement comprising: means mounting the sensing member for lateral movement between a central position, in which the tool is in said forward-rearward alignment with the sensing member, and laterally offset positions on opposite sides of said central position; and powered means, effective during said support movement, for effecting lateral movements of the sensing member from each of said positions to a selected other of said positions.

2. The machine of claim 1 characterized in comprising: adjusting means adjusting the extent of lateral movement imparted by the powered means to the sensing member laterally of its central position to thereby adjust the laterally offset positions of the sensing member.

3. The machine of claim 1 characterized in that said means mounting the sensing member for lateral movement and said means for effecting said lateral movements of the sensing member comprise: a forwardly-rearwardly extending bar so pivoted intermediate the ends of the bar by a pivot member as to permit lateral swinging movements of the bar about the axis of the pivot member, said sensing member being mounted to the front of the bar forwardly of the pivot member; a first motor mounted on a first side of the bar; a second motor mounted on a second side of the bar; a first drive rod and a second drive rod respectively extending inwardly of the first motor and the second motor towards the rear of the bar rearwardly of the pivot member; means so relating the drive rods to each other and to said rear of the bar rearwardly of the pivot member as to effect lateral movements of the bar about the pivot member pursuant to inward-outward movements of the drive rods; and means so actuating the motors as to effect the lateral movements of the bar and thus effect said lateral movements of the sensing member.

4. The machine of claim 3 characterized in comprising: a stop member adjustably mounted on each side of the bar for inward-outward adjustment, said stop members being in intersecting relationship with the bar to adjust the extent of lateral movements of the bar to thereby adjust the laterally offset positions of the sensing member.

5. The machine of claim 3 characterized in comprising: a first stop member mounted on the first side of the bar in intersecting relationship with the first side of the bar; a second stop member mounted on the second side of the bar in intersecting relationship with the second side of the bar; characterized in that the inner ends of the first and second drive rods are in intersecting relationship; characterized in that said means so relating the drive rods to each other and to said rear of the bar comprises: a connection between the first drive rod and said rear of the bar so constituted as to effect said lateral movement of the bar pursuant to inward-outward movement of the first drive rod; characterized in that the second motor incorporates limit means for limiting the extent of inward movement of the second drive rod; characterized in comprising: actuable means for causing the first motor to selectively impart inwardly or outwardly directed forces to the first drive rod; and actuable means for causing the second motor to selectively impart an inwardly directed force to the second drive rod of greater magnitude than the inwardly directed force imparted to the first drive rod by the first motor or to relieve the inwardly directed force imparted to the second drive rod; and characterized in that said means for so actuating the motors comprises: means so actuating the first and second motors as to impart the inwardly directed forces to the first and second drive rods so that the inner ends of the drive rods abut each other with the limit means determining the positions of the drive rods and the connection places the sensing member in the central position; means so actuating the second motor that the force imparted by the second motor is relieved thereby enabling the inwardly directed force applied to the first drive rod by the first motor to move the first drive rod further inwardly and thereby move the bar laterally until the bar engages the second stop member and the connection causes the sensing member to move into a first of said laterally offset positions; and means so actuating the first motor as to impart the outwardly directed force to the first drive rod to move the first drive outwardly and thereby move the bar laterally until the bar engages the first stop member and the connection causes the sensing member to move into the second of said laterally offset positions.

6. The machine of claim 5 characterized in comprising: means adjustably mounting the stop members for inward-outward adjustment to adjust the laterally offset positions of the sensing member.

* * * * *